US010087051B2

(12) United States Patent
Assfalg et al.

(10) Patent No.: US 10,087,051 B2
(45) Date of Patent: Oct. 2, 2018

(54) CRANE COMPRISING A CRANE CANTILEVER ARM, WHEREIN THE CURRENT IS SUPPLIED TO THE LOAD HOOK AND/OR CRANE TROLLEY VIA A ROPE TRANSMITTING TRACTIVE FORCES

(71) Applicant: Liebherr-Werk Biberach GmbH, Biberach an der Riss (DE)

(72) Inventors: Martin Assfalg, Attenweiler (DE); Werner Breh, Riedlingen (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 425 days.

(21) Appl. No.: 14/783,673

(22) PCT Filed: Mar. 18, 2014

(86) PCT No.: PCT/EP2014/000734
§ 371 (c)(1),
(2) Date: Oct. 9, 2015

(87) PCT Pub. No.: WO2014/166582
PCT Pub. Date: Oct. 16, 2014

(65) Prior Publication Data
US 2016/0083229 A1 Mar. 24, 2016

(30) Foreign Application Priority Data
Apr. 9, 2013 (DE) ..... 10 2013 006 108

(51) Int. Cl.
*B66C 13/00* (2006.01)
*B66C 13/12* (2006.01)
(Continued)

(52) U.S. Cl.
CPC ..... *B66C 13/12* (2013.01); *B66C 1/34* (2013.01); *B66C 11/16* (2013.01); *B66C 13/18* (2013.01);
(Continued)

(58) Field of Classification Search
CPC .... B66C 7/02; B66C 7/04; B66C 7/06; B66C 11/16; B66C 13/12; B66C 13/18; B66C 23/26; D07B 1/147
See application file for complete search history.

(56) References Cited

U.S. PATENT DOCUMENTS 2,600,887 A 6/1952 Lannen
3,382,011 A * 5/1968 Mascarello ..... B65G 53/30 406/164
(Continued)

FOREIGN PATENT DOCUMENTS

CN 1094373 A 11/1994
CN 2529419 Y 1/2003
(Continued)

OTHER PUBLICATIONS

State Intellectual Property Office of the People's Republic of China, Office Action and Search Report Issued in Application No. 201480020335.8, Jul. 15, 2016, 20 pages.
(Continued)

*Primary Examiner* — Emmanuel M Marcelo
(74) *Attorney, Agent, or Firm* — McCoy Russell LLP

(57) ABSTRACT

The present disclosure concerns a crane, in particular a tower crane, with a jib from which a load hook can be raised and lowered via a hoisting cable, and with an electric power supply to the load hook and/or to a trolley that may be movable along the crane jib. According to the disclosure, the electric power supply to the load hook and/or to the trolley
(Continued)

is at least partly conducted by a running cable which transmits tractive forces for the crane operation.

17 Claims, 3 Drawing Sheets

(51) Int. Cl.

| | |
|---|---|
| ***B66C 1/34*** | (2006.01) |
| ***B66C 23/26*** | (2006.01) |
| ***D07B 1/14*** | (2006.01) |
| ***B66C 11/16*** | (2006.01) |
| ***B66C 13/18*** | (2006.01) |

(52) U.S. Cl.
CPC ..... *B66C 23/26* (2013.01); *D07B 1/147* (2013.01); *D07B 2501/2015* (2013.01)

(56) References Cited

U.S. PATENT DOCUMENTS

| | | | | |
|---|---|---|---|---|
| 3,567,040 | A * | 3/1971 | Thomson | B63B 27/04 212/242 |
| 4,277,053 | A * | 7/1981 | Simon | B66C 23/52 254/326 |
| 5,489,032 | A * | 2/1996 | Mayhall, Jr. | B66C 23/208 182/129 |
| 2002/0023891 | A1 | 2/2002 | Verchere et al. | |
| 2004/0026349 | A1 * | 2/2004 | Colgate | B66C 17/00 212/284 |
| 2007/0235404 | A1 * | 10/2007 | Catanzaro | B66C 13/44 212/312 |
| 2011/0278252 | A1 * | 11/2011 | De Carvalho Cal | B66C 13/16 212/279 |
| 2012/0271582 | A1 * | 10/2012 | Bageshwar | B66C 13/46 702/92 |
| 2013/0299440 | A1 * | 11/2013 | Hermann | B66C 13/46 212/276 |
| 2015/0053636 | A1 * | 2/2015 | Pa mann | B66C 6/00 212/71 |

FOREIGN PATENT DOCUMENTS

| | | | |
|---|---|---|---|
| DE | 837666 | C | 1/1952 |
| DE | 1284806 | B | 12/1968 |
| DE | 3741192 | A1 | 6/1989 |
| DE | 4020843 | C1 | 5/1991 |
| GB | 223705 | A | 10/1924 |
| JP | 2003096679 | A | 4/2003 |
| WO | 0178086 | A1 | 10/2001 |

OTHER PUBLICATIONS

ISA European Patent Office, International Search Report Issued in Application No. PCT/EP2014/000734, dated May 20, 2014, WIPO, 5 pages.

* cited by examiner

CRANE COMPRISING A CRANE CANTILEVER ARM, WHEREIN THE CURRENT IS SUPPLIED TO THE LOAD HOOK AND/OR CRANE TROLLEY VIA A ROPE TRANSMITTING TRACTIVE FORCES

CROSS REFERENCE TO RELATED APPLICATIONS

The present application is a U.S. National Phase of International Patent Application Serial No. PCT/EP2014/000734, entitled "Crane Comprising a Crane Cantilever Arm, Wherein the Current is Supplied to the Load Hook and/or Crane Trolley Via a Rope Transmitting Tractive Forces," filed on Mar. 18, 2014, which claims priority to German Patent Application No. 10 2013 006 108.3, filed on Apr. 9, 2013, the entire contents of each of which are hereby incorporated by reference in their entirety for all purposes.

TECHNICAL FIELD

The present disclosure relates to a crane, in particular a tower crane, with a crane jib from which a load hook can be raised and lowered via a hoisting cable. An electric power supply that is movable along the crane jib may be provided to the load hook and/or to a trolley.

BACKGROUND AND SUMMARY

For certain hoisting operations, it is necessary or at least helpful to have an electric power supply available on the load rigging or load hook such as electrical hoist magnets which allow magnetic hoisting operations, or to have other attachment devices, for example with electrical servomotors on the load hook. If the crane has a trolley on the jib, as is the case, for example, for tower cranes, it may be necessary or helpful to have a power connection on the trolley, either to forward the power from the trolley to the load hook via a spring cable reel, or to supply other consumers on the trolley with power, such as spotlights or other electrical devices.

It has already been suggested to provide the trolley and/or the load hook with a power connection by means of transporting electrical energy with trailing cables, first to the trolley and then via spring cable reels down to the load hook. However, such an installation of trailing cables and spring cable reels on the jib is very bulky and suitable only for stationary cranes where space requirements and easy assembly do not play a major role. In the case of fast-erecting cranes or so-called taxi cranes—which are often assembled on a day-to-day basis or even several times a day, and which are seldom assembled and disassembled on a weekly basis—it is of great importance that they can be easily collapsed and folded for road transport and that there are no weight problems for the jig. With such fast-erecting and fast-response cranes, the above described electrical supply solutions for electrical devices on the trolley or on the load hook are not satisfactory.

It is therefore the object of the present disclosure to provide an improved crane of the kind described above, which does not have the disadvantages of the state of the art. In this simple and efficient way electrical energy may be provided to the load hook and/or the trolley of the crane without compromising the ease of installation and without requiring excessive space for bulky components on the jib.

According to the present disclosure, the said object is achieved by means of a crane comprising a crane jib; a load hook that can be raised and lowered via a hoisting cable from the crane jib and an electric power supply connected to the load hook and/or to a trolley. The electric power supply is movable along the crane jib, and the power supply to the load hook and/or to the trolley is at least partly conducted via a running cable which transmits tractive forces for the crane operation.

It is therefore suggested to integrate the power supply in a running cable of the crane leading to the movable component where the power connection is needed, and to use the running cable simultaneously for power transmission, in addition to its actual purpose. Due to this double function of the running cable, bulky components can be eliminated, and installation can be made easier. According to the present disclosure, the electric power supply to the load hook and/or to the trolley is provided partly by a running cable which transmits tractive forces as required for the crane operation. The cable is designed as an electric traction cable which can simultaneously transmit tractive forces and conduct electric power.

In another example, where the crane has a trolley movable along the jib, a trolley cable that moves the trolley can be electrically conductive to supply a power connection provided on the trolley. An inner trolley rope, which connects the trolley with an inner jib end (usually linked to the tower), or with a deflection pulley, can be electrically conductive as indicated above or designed as an electric traction cable, such that the power connection or current collector on the trolley can be supplied with electric power via the inner trolley cable with which the trolley can be pulled or moved to the inner end of the jib.

Alternatively or additionally, an outer trolley cable that connects the trolley with an outer projecting jib end can be designed as an electric traction cable to provide the trolley with electricity. In yet another example, the outer trolley cable can be designed as a conventional traction cable instead of an electric traction cable, in which case the outer trolley cable can be thinner and lighter than an electric traction cable, which has the advantage that the outer jib half, which is critical for the moment load, would be lighter.

Advantageously, the power input into the electrically conductive trolley cable can be in the region of the trolley cable winch. The trolley cable can be connected to the trolley winch with power input means which may comprise a slip ring transmitter. Advantageously, the trolley cable can be connected to the trolley winch and connected by at least one electric conductor to a power connection that rotates with the winch which can be supplied via the said slip ring transmitter.

To conduct the electric power from the trolley to the load hook, an electric cable can be provided between the trolley and the load hook or a power connector attached to the load hook, and this cable can by means of a spring cable reel either follow or equalize the changes in distance caused by the raising and lowering of the load hook. In a further example, the said spring cable reel is not provided on the trolley, but on the load hook or on an attachment connected thereto. This eliminates the need for space required by the relatively bulky spring cable reel in the trolley region, which is especially important for fast-erecting cranes which do not have much room to spare in the collapsible transport mode. Furthermore, the spring cable reel can simply be taken off and used in cases when it is really needed.

Advantageously, a plug-in connection, for example in the form of a socket or plug, to connect the electric cable leading to the load hook, can be provided on the trolley.

Alternatively or additionally, a power connection provided or required in the area of the load hook can also be supplied with electricity directly via the hoisting cable leading to the load hook. The hoisting cable can also be electrically conductive or designed as an electric traction cable comprising at least one electrical conductor.

A power supply to the load hook directly via the hoisting cable is of advantage when the jib of the crane from which the load can be raised or lowered, is an adjustable jib, for example in the form of a luffing jib that can be luffed up and down and/or a telescoping jib and/or in connection with a single-cable reeving system and/or a multi-cable reeving system in which a hoisting cable is attached to the load hook and/or with an attachment connected thereto.

If the hoisting cable is designed as an electric traction cable, electricity can be advantageously supplied in the region of the hoisting cable winch. In the region of the hoisting cable winch, the hoisting cable can be connected with power input means which may comprise a slip ring transmitter. In that respect, the power input can also be transferred to the trolley cable as explained above.

Below, the systems and methods for the crane are described in detail with reference to preferred embodiments and to the associated drawings.

DETAILED DESCRIPTION

Figure 1:
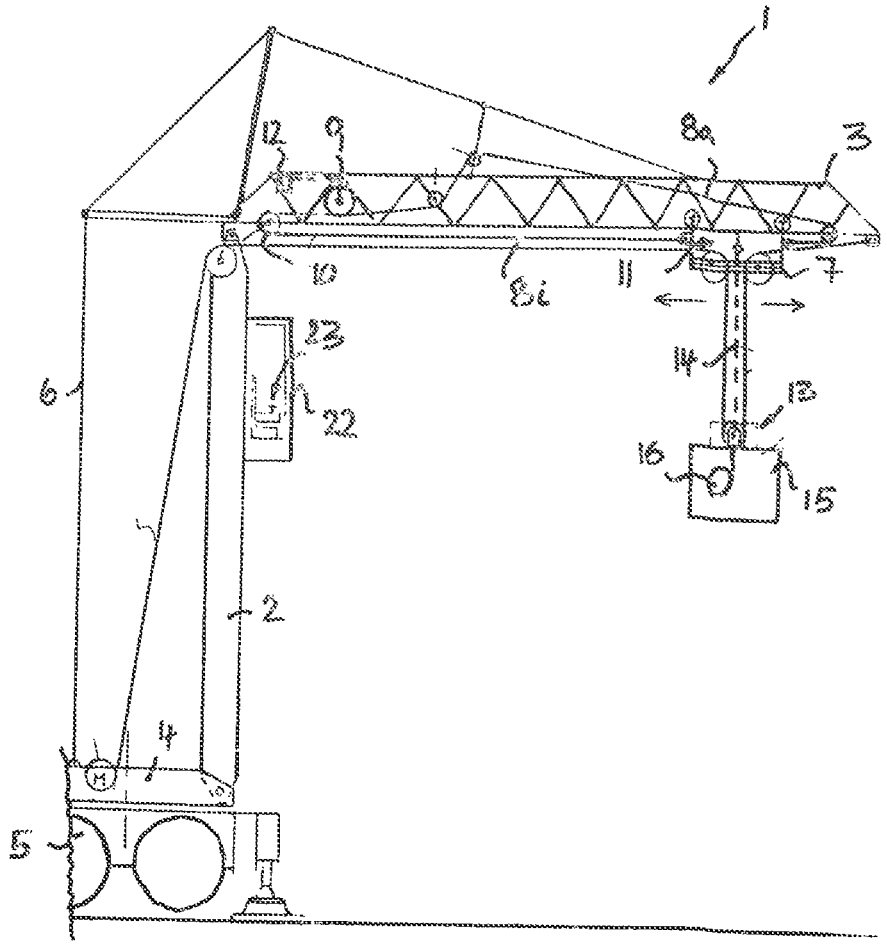
FIG. 1 shows a schematic lateral view of a fast-erecting crane designed as a tower crane according to an advantageous embodiment of the present disclosure, whereby a trolley movable along the crane jib is supplied with electricity via the trolley cable, whereby electricity is conducted to the load hook or the electrical devices attached thereto via a spring cable reel provided on the load hook or on an attachment thereto.

As FIG. 1 shows, crane 1 can be designed as a tower crane and be provided with a tower 2 carrying a projecting jib 3. The lower end of tower 2 can sit on a turntable 4 which can rotate about a vertical axis and is supported on an undercarriage 5 which can be designed as a truck or other movable object but may also form a rigid immovable support base.

Figure 2:
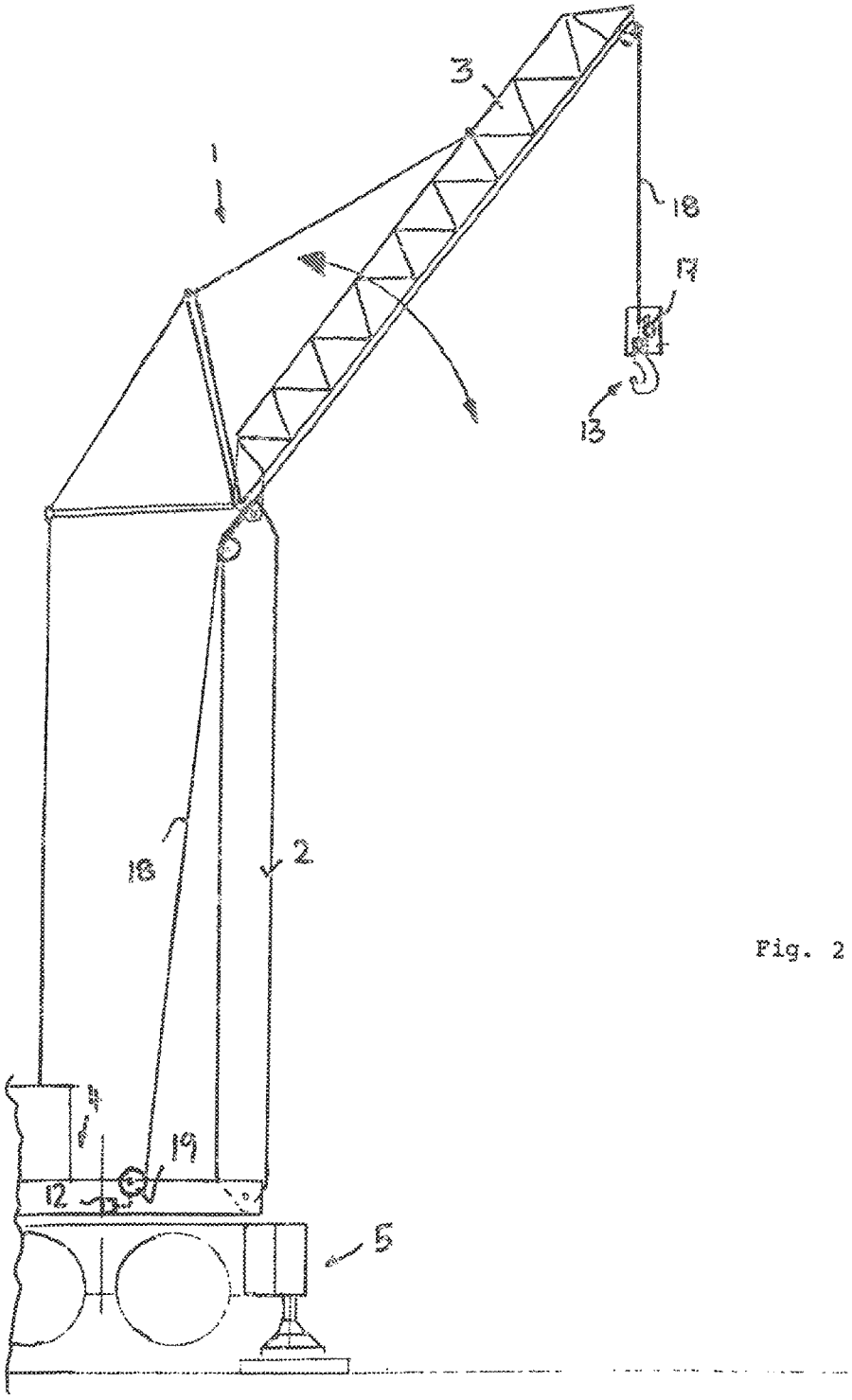
FIG. 2 shows a schematic lateral view of a fast-engaging crane similar to that in FIG. 1 designed as a tower crane, whereby an electric power supply to the load hook is conducted directly via the hoisting cable.

The jib 3 can be braced by a bracing 6 whereby the bracing 6 can be of adjustable design to luff the jib 3 up and down, as shown in FIG. 2.

Crane 1 can be designed as a fast-erecting crane whose tower 2 can be telescoped and whose jib 3 can be collapsed or telescoped such that the tower and the jib can be folded into a transport mode for road transport.

As FIG. 1 shows, a trolley 7 can be mounted to be movable along jib 3 such that it can be moved back and forth along jib 3 by means of a trolley cable 8. An inner trolley cable **8*i* leads trolley 7 via a deflecting pulley 10 on the inner end of jib 3 near the tower, toward a trolley winch 9, while an outer trolley cable 8*a* leads via a deflecting pulley 10 at the outer end of jib 3 to the said trolley winch 9**.

Advantageously the inner trolley cable **8*i* can be electrically conductive or designed as an electric fraction cable to conduct the electrical current to a power connection 11 on trolley 7. Power can be supplied to the trolley cable 8 on the trolley winch 9**, whereby the power can be supplied by means of suitable power input means on the pulley winch, for example in the form of a slip ring transmitter.

Advantageously an appropriate electrical installation with residual current circuit breaker 12 is provided and connected to the trolley cable 8, for example in the region of the power input means on the trolley winch 9.

To conduct the electric current from trolley 7 to a power connection or electrical device on load hook 13, an electric cable 14 can be provided between trolley 7 and load hook 13, whereby that cable's end on the trolley side can, for example, be connected to the trolley cable with power connection 11, for example via an appropriate plug/socket connection or other detachable power connection means.

To be able to follow or equalize the lowering and raising motions of load hook 13, a spring cable reel 16 can be provided on load hook 13 or to an attachment 15 connected thereto; as seen in FIG. 1.

As shown in FIG. 2, an electrical device or power connection 17 on load hook 13 or on an attachment connected thereto can also be supplied with electrical energy directly via hoisting cable 18, whereby in this case the hoisting cable 18 is appropriately electrically conductive or designed as an electric traction cable. This embodiment is especially advantageous in cranes with an adjustable jib which can be luffed up and down as shown, for example, in FIG. 2. Advantageously in such a case, hoisting cable 18 is attached to load hook 13 with a single-cable reeving system. In case of a multi-cable reeving system, the cables are advantageously run in such a way that one end of the hoisting cable 18 is attached to load hook 13 and/or that the end with the said power connection 17 is connected in the region of load hook 13.

Advantageously, the power input into hoisting cable 18 can be on the hoisting cable winch 19, whereby—as described for the trolley winch—the power input means can, for example, be provided with a slip ring transmitter. Corresponding electrical installations can be provided with a residual current circuit breaker 12.

Figure 3:
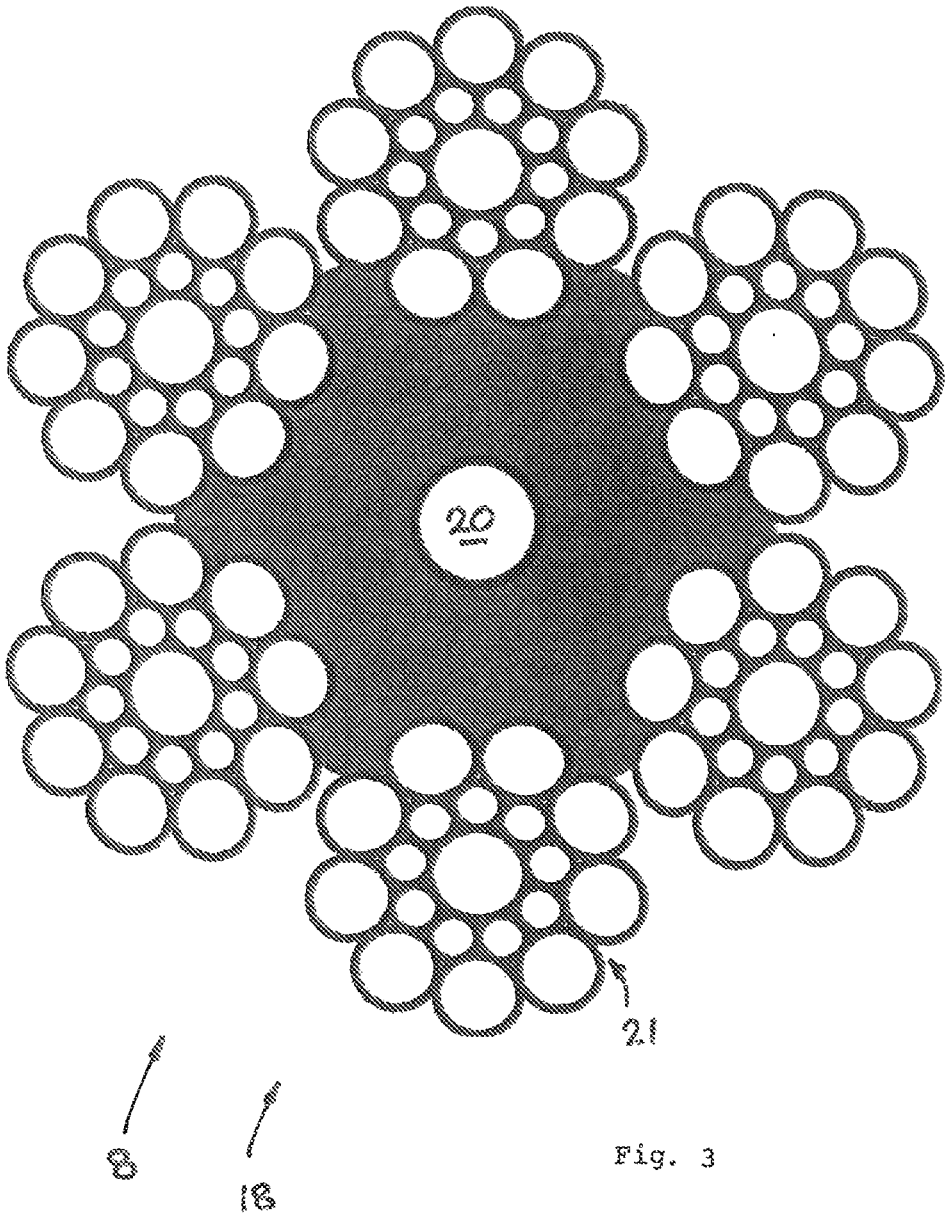
FIG. 3 shows a schematic cross-sectional view of a trolley cable or hoisting cable designed as an electric traction cable showing the arrangement of the electrical conductor in the cable core.

As shown in FIG. 3, the electrically conductive trolley cable 8 or hoisting cable 18 can comprise at least one electrical conductor 20 embedded in the cable core and surrounded on the outside by several strands 21 which can serve as grounding conductors.

FIGS. 1 through 3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

As shown in FIGS. 1 and 2, control switches 23 or other inputs advantageously designed to be freely programmable, can be provided at the control stand 22 of the crane or at another appropriate location, for example, to radio-control attachment devices on load hook 13. Alternatively or additionally, appropriate switches or inputs can also be provided on a radio remote control of the crane.

The invention claimed is:

1. A crane, comprising:

a crane jib;

a load hook that can be raised and lowered from the crane jib via a hoisting cable;

a moving trolley cable that is electrically conductive and supplies a power connection on a trolley; and an electric power supply connected to the load hook and/or to the trolley, wherein one or more of the electric power supply and the trolley is movable along the crane jib, wherein the electric power supply to the load hook and/or to the trolley is at least partly conducted via a running cable which transmits tractive forces for the crane operation.

2. The crane according to claim 1, wherein the electrically conductive trolley cable forms an inner trolley cable which leads from the trolley to an inner jib end section.

3. The crane according to claim 1, wherein the trolley cable is arranged on a trolley winch that is arranged on the crane jib and is connected with a power source comprising a slip ring transmitter.

4. The crane according to claim 1, wherein the power supply to the load hook is provided at least partly via an electrically conductive hoisting cable.

5. The crane in accordance with claim 1, wherein the crane is a tower crane.

6. A crane, comprising:

a crane jib;

a load hook that can be raised and lowered from the crane jib via a hoisting cable; and an electric power supply connected to the load hook and/or to a trolley, wherein one or more of the electric power supply and the trolley is movable along the crane jib, the power supply to the load hook and/or to the trolley is at least partly conducted via a running cable which transmits tractive forces and the power supply comprises a spring cable reel with a power cable between the trolley and the load hook.

7. The crane in accordance with claim 6, wherein the spring cable reel is arranged on the load hook and/or on an attachment part connected to the load hook.

8. A crane, comprising:

a crane jib;

a load hook that can be raised and lowered from the crane jib via a hoisting cable; and an electric power supply connected to the load hook and/or to a trolley, wherein one or more of the electric power supply and the trolley is movable along the crane jib, the power supply to the load hook is provided at least partly via an electrically conductive hoisting cable, and the hoisting cable is connected to a hoisting cable winch with a power source comprising a slip ring transmitter.

9. A crane, comprising:

a crane jib;

a load hook that can be raised and lowered from the crane jib via a hoisting cable;

an electric power supply connected to the load hook and/or to a trolley, wherein one or more of the electric power supply and the trolley is movable along the crane jib, wherein the power supply to the load hook and/or to the trolley is at least partly conducted via a running cable which transmits tractive forces; and a controller configured with computer readable instructions stored in non-transitory memory for: controlling an electrical attachment device, wherein the attachment device is supplied with electricity via the electric power supply, and wherein the attachment device is attached to a control stand and/or to a radio remote control of the crane.

10. A method for a crane, comprising:

pulling and/or moving a trolley along a crane jib with an electrically conductive trolley cable; and supplying power to a power connection on the trolley via the trolley cable.

11. The method of claim 10, wherein the pulling and/or moving includes transmitting tractive forces to move the crane.

12. The method of claim 10, further comprising transmitting power from the power connection on the trolley to a load hook on the crane jib to move the load hook.

13. The method of claim 10, wherein the pulling and/or moving and the supplying is performed while raising or lowering one or more of the crane jib and the load hook.

14. A method for a crane, comprising:

moving an electric power supply coupled to a trolley along an adjustable crane jib;

simultaneously transmitting tractive forces from the trolley to the crane jib via an electrically conductive cable for raising or lowering the crane jib while supplying electricity from the electric power supply to a load hook on the crane jib via the electrically conductive cable.

15. The method of claim 14, wherein the supplying electricity is performed while raising or lowering the crane jib, and while raising or lowering the load hook.

16. The method of claim 15, further comprising:

equalizing the raising or lowering of the load hook via a spring cable reel coupled to the load hook.

17. The method in accordance with claim 14, wherein the electrically conductive cable is a hoisting cable attached to the load hook with a single-cable or multi-cable reeving system.

* * * * *